US008699729B2

(12) United States Patent
Fathollahi

(10) Patent No.: US 8,699,729 B2
(45) Date of Patent: Apr. 15, 2014

(54) AUDIO SPEAKER ASSEMBLY

(76) Inventor: Nausser Fathollahi, Irvine, CA (US)

( * ) Notice: Subject to any disclaimer, the term of this patent is extended or adjusted under 35 U.S.C. 154(b) by 38 days.

(21) Appl. No.: 13/315,092

(22) Filed: Dec. 8, 2011

(65) Prior Publication Data

US 2012/0148084 A1 Jun. 14, 2012

Related U.S. Application Data

(60) Provisional application No. 61/422,058, filed on Dec. 10, 2010.

(51) Int. Cl.
*H04R 25/00* (2006.01)

(52) U.S. Cl.
USPC ..... 381/182; 381/152; 381/431

(58) Field of Classification Search
USPC ..... 381/152, 182, 190–191, 423–429, 431
See application file for complete search history.

(56) References Cited

U.S. PATENT DOCUMENTS 5,793,877 A 8/1998 Tagg
6,332,029 B1 12/2001 Azima et al.
6,442,282 B2 8/2002 Azima et al.
6,519,349 B1 2/2003 Azima et al.
6,522,760 B2 2/2003 Azima et al.
6,610,237 B2 8/2003 Azima et al.
6,618,487 B1 9/2003 Azima et al.
6,720,708 B2 4/2004 Athanas
6,751,333 B1 6/2004 Azima et al.
6,904,154 B2 6/2005 Azima et al.
7,062,051 B2 6/2006 Harris et al.
7,120,263 B2 10/2006 Azima et al.
7,158,647 B2 1/2007 Azima et al.
7,174,025 B2 2/2007 Azima et al.
7,194,098 B2 3/2007 Azima et al.
7,386,144 B2 6/2008 Vincent et al.
7,639,826 B1 12/2009 Azima et al.
2009/0176534 A1 7/2009 Lee et al.
2009/0285431 A1 11/2009 Carlson et al.
2010/0215930 A1 8/2010 Delatte

*Primary Examiner* — Suhan Ni
(74) *Attorney, Agent, or Firm* — Fountain Law Group, Inc.; George L. Fountain

(57) ABSTRACT

An audio speaker assembly including a housing defining an internal compartment, and a glass membrane having a first portion supported in the housing and a second portion extending externally from the housing. The second portion having a length greater than its width, the length of the second portion extending orthogonal to the width of the housing, the second portion defining at least one aperture and a curved section formed along an edge of the glass membrane. A driver is mounted to the membrane that is responsive to an electrical signal causing the membrane to vibrate.

20 Claims, 11 Drawing Sheets

AUDIO SPEAKER ASSEMBLY

CROSS REFERENCE TO RELATED APPLICATION

This application claims the benefit of the filing date of patent application, Ser. No. 61/422,058, filed on Dec. 10, 2010, and entitled "Audio Speaker Assembly," which is incorporated herein by reference.

FIELD

This disclosure relates to a speaker assembly, and specifically, to a speaker assembly having a flat, vertically extending glass membrane.

BACKGROUND

Conventional audio speakers use relatively rigid paper or plastic cones, or diaphragms, and require an air enclosure to provide acceptable sound reproduction in the low/mid frequency regions where voices and musical instruments produce most of their sound energy. The air enclosures inherently "resonate" in such a manner as to accentuate some frequencies while diminishing others.

Conventional cone speakers typically require multiple speaker elements, such as woofers, midranges, and tweeters. Each element provides reproduction of a different frequency range of sound. Unfortunately, it is difficult with such multi-element designs to provide smooth transitions between the speaker elements at all listening angles.

The air enclosure and multi-element design result in reduced naturalness and clarity of the reproduced sound. What is needed is an audio speaker without the need for an air enclosure, to remove or reduce altered and unnatural acoustic effects, and with improved sound quality.

SUMMARY

An aspect of the disclosure relates to an audio speaker assembly configured to produce sound with varying frequency from distinct regions of the speaker assembly. The audio speaker assembly comprises an elongated planar membrane adapted to produce sound with a first frequency response that varies along the length of the planar membrane. A housing, configured to support the planar membrane, is configured to have a second frequency response that differs from the first frequency response of the elongated planar membrane.

A first transducer, configured to efficiently apply vibrational energy in accordance with the first frequency response of the elongated planar membrane, is directly coupled to the planar membrane. A second transducer, configured to efficiently apply vibrational energy in accordance with the second frequency response of the housing, is directly coupled to the housing.

A signal processing unit is provided to generate first and second drive signals for the first and second transducers from an input audio signal, respectively. The first drive signal has a frequency content that better matches the first frequency response of the elongated planar membrane. Similarly, the second drive signal has a frequency content that better matches the second frequency response of the housing.

As an example of the above concepts, the housing may serve as a base to support the elongated planar membrane in a generally vertical orientation. The elongated planar membrane may be configured to more efficiently produce sound in a high audio frequency range along an upper region of the membrane, and more efficiently produce sound in an upper mid-frequency range along central and lower regions of the membrane. The housing may be configured to more efficiently produce sound in a low to lower-mid frequency range.

The first transducer, directly coupled to the planar membrane, may be configured to more efficiently generate vibrational energy in the upper mid- and high frequency audio range. Similarly, the second transducer, directly coupled to the housing, may be configured to more efficiently generate vibrational energy in the low and lower mid- frequency audio range.

The first drive signal for the first transducer may include substantially only the upper mid- and high frequency components of the input audio signal. Similarly, the second drive signal for the second transducer may include substantially only the low and lower mid-frequency components of the input audio signal. Such configuration results in lower frequency sound being efficiently produce at a lower region of the speaker assembly with a smooth transition to higher frequency sound being efficiently produce at an upper region of the speaker assembly. This gives the speaker assembly a smooth spatial frequency diversity along the vertical axis of the speaker assembly.

In another aspect, the disclosure provides an audio speaker assembly. The audio speaker assembly includes a housing having a base defining an internal compartment. The audio speaker assembly also includes a membrane having a width, a length and a thickness. A first portion of the membrane is supported in the housing and a second portion of the membrane extends externally from the housing. The length of the membrane external to the housing extends orthogonal to the base of the housing. The audio speaker assembly also includes a driver mounted to the membrane. The driver is responsive to an electrical signal causing the membrane to vibrate.

In another aspect, an audio speaker assembly is provided including a housing defining an internal compartment, having a width and a length, and a glass membrane having a first portion supported in the housing and a second portion extending externally from the housing. The second portion of the membrane having a length greater than its width. The length of the second portion extending orthogonal to the width of the housing. A driver is mounted to the membrane that is responsive to an electrical signal causing the membrane to vibrate.

In yet another aspect, an audio speaker is provided including a housing defining an internal compartment, having a width and a length, and a glass membrane having a first portion supported in the housing and a second portion extending externally from the housing. The second portion has a length greater than its width, and the length of the second portion extends orthogonal to the width of the housing. The second portion defines at least one aperture and a curved section formed along an edge of the glass membrane. A driver is mounted to the membrane. The driver is responsive to an electrical signal that causes the driver and thus the membrane to vibrate. The audio speaker assembly also includes lighting effects positioned along the housing and the glass membrane, and a wireless receiver coupled to the driver and the lighting effects to operate the driver and the lighting effects remotely.

Other aspects, advantages and novel features of the present disclosure will become apparent from the following detailed description when considered in conjunction with the accompanying drawings.

Figure 1A:
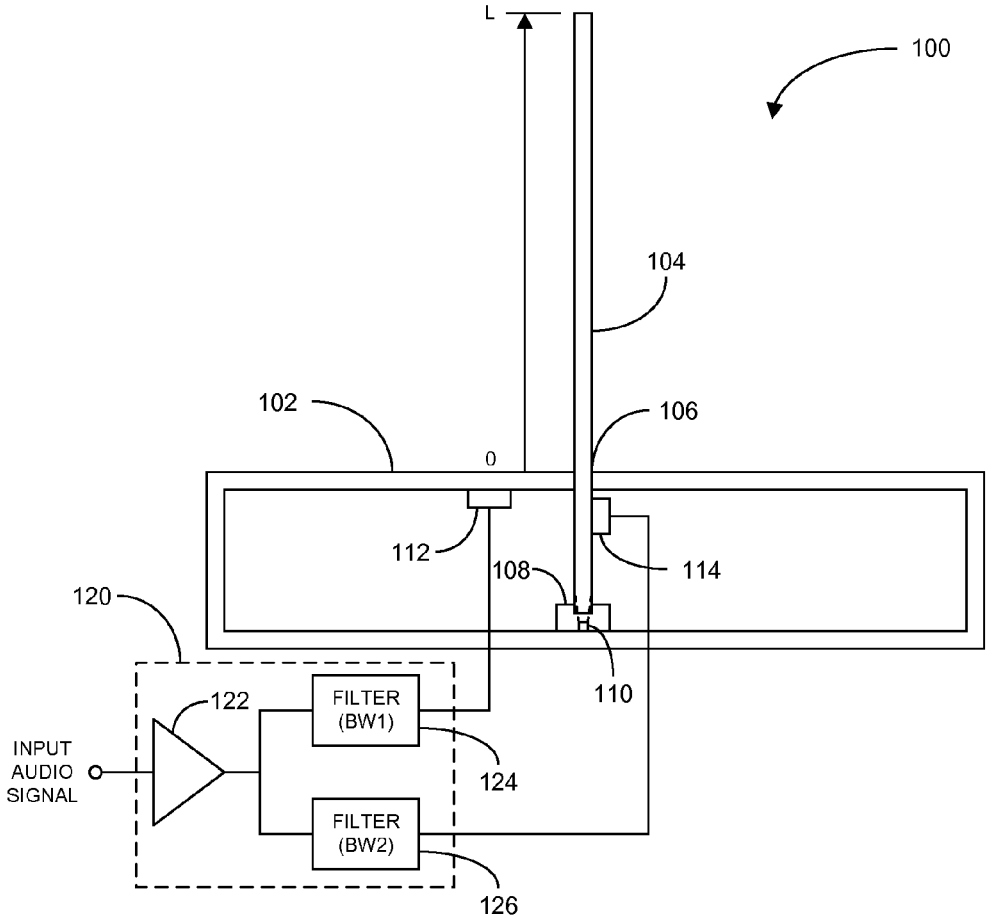
FIG. 1A illustrates a diagram of an exemplary audio speaker assembly in accordance with an aspect of the disclosure.

It should be appreciated that for simplicity and clarity of illustration, elements shown in the figures have not necessarily been drawn to scale. For example, the dimensions of some of the elements are exaggerated relative to each other for clarity. Further, where considered appropriate, reference numerals have been repeated among the figures to indicate corresponding elements.

DETAILED DESCRIPTION OF THE EXEMPLARY EMBODIMENTS

FIG. 1A illustrates a diagram of an audio speaker assembly 100 in accordance with an aspect of the disclosure. In summary, the audio speaker assembly 100 is configured to provide spatial diversity as to the origin from which different frequency components of audio sound are generated. That is, the audio speaker assembly 100 is adapted to generate a wide spectrum of audio sounds from different locations along the audio speaker assembly.

Continuing the summary, the audio speaker assembly 100 accomplishes this spatial frequency diversity by first employing a planar membrane (e.g., made out of a tempered glass) having a frequency response that varies along a length of the membrane. As an example, the planar membrane is adapted to generate audio in an upper mid-frequency range along lower and central regions of the membrane, and generate audio in a high-frequency range along an upper region of the membrane. In order to better implement the production of high frequency audio in the upper region of the membrane, the mass of the membrane is reduced at the upper region by incorporating a curved edge to narrow its width at that region, and one or more thru-holes.

Continuing the summary, to further effectuate the spatial frequency diversity, the audio speaker assembly 100 includes a housing that supports the planar membrane in a generally vertical orientation. The housing is adapted to produce audio in the low and lower mid-frequency ranges. The housing may be made out of a wood material.

Continuing the summary, the audio speaker assembly 100 further includes a first transducer directly coupled to the housing. The first transducer is adapted to more efficiently transfer audio to the housing in the low- and lower mid-frequency ranges. Because the housing is mechanically coupled to the planar membrane in order to support it in a vertical orientation, some of the audio in the lower mid-frequency range from the first transducer is transferred to the planar membrane. This lower mid-frequency audio component will be produced as sound at the lower region of the planar membrane.

Continuing the summary, the audio speaker assembly 100 further includes a second transducer directly coupled to the planar membrane. The second transducer is adapted to more efficiently transfer audio to the planar membrane in the upper mid- and high-frequency ranges. Because the housing is mechanically coupled to the planar membrane in order to support it in a vertical orientation, some of the audio in the upper mid-frequency range from the second transducer is transferred to the housing.

Continuing the summary, the audio speaker assembly 100 further includes a first filter (or first preamplifier) configured to amplify and filter an input audio signal in order to output the low and lower mid-frequency components of the audio signal. The output of the first filter is coupled to the first transducer. Similarly, the audio speaker assembly 100 further includes a second filter (or second preamplifier) configured to amplify and filter the input audio signal in order to output the upper mid- and high-frequency components of the audio signal. The output of the second filter is coupled to the second transducer.

With reference to FIG. 1A, the audio speaker assembly 100 comprises a housing 102 and a planar membrane 104. As previously discussed, the housing 102 may be formed of a wooden or other materials suitable to more efficiently produce sound in the low and lower mid-frequency ranges. The planar membrane 104 may be formed of tempered glass or other materials suitable to efficiently produce sound in the upper mid- and high frequency ranges. The housing 102 includes a slot 106 along its upper wall through which the planar membrane 104 extends in a fitted configuration. A bottom portion of the planar membrane 104 is anchored proximate a bottom wall of the housing 102 by an anchoring device 108. The anchoring device 108 may include a light source 110 (e.g., a light emitting diode (LED) light strip) adapted to produce ornamental colored light through the planar membrane 104, such as tempered glass.

A first transducer 112 is directly coupled or attached to the housing 102, for example, along an inside surface of the upper wall of the housing. As an example, the first transducer 112 may be adapted to more efficiently produce sound vibrations in the housing 102 in a low and lower mid-frequency range of an input audio signal. A second transducer 114 is directly coupled to or attached to the planar membrane 104, for example, at a lower region of the planar membrane situated within the housing 102. As an example, the second transducer 114 may be adapted to more efficiently produce sound vibrations in the planar membrane 104 in an upper mid- and high-frequency ranges of an input audio signal. It shall be understood that the term "directly coupled or attached to" means that the transducer makes contact with the corresponding element, or makes contact with the corresponding element via an insignificant material.

The audio speaker assembly 100 further comprises an audio signal processing unit 120 including a pre-amplifier 122, a first filter 124, and a second filter 126. The pre-amplifier 122 is adapted to receive and amplify an input audio signal. The first filter 124 is adapted to filter the amplified audio signal to generate an audio signal with a first defined spectrum. For example, the first filter 124 may be adapted to output the low- and lower mid-frequency components (BW1) of the amplified audio signal. Similarly, the second filter 126 is adapted to filter the amplified audio signal to generate an audio signal with a second defined spectrum. For example, the second filter 126 may be adapted to output the upper mid- and high-frequency components (BW2) of the amplified audio signal. The output audio signals from the first and second filters 124 and 126 drive the first and second transducers 112 and 114, respectively. It shall be understood that the audio signal processing unit 120 may include instead two pre-amplifiers tuned to distinct frequency bands (e.g., BW1 and BW2).

In this configuration, the audio speaker assembly 100 is adapted to: (1) efficiently produce sound at the high-frequency range along an upper region of the planar membrane 104; (2) efficiently produce sound at an upper mid-frequency range along a mid- and lower-portion of the of the planar membrane 104; and (3) efficiently produce sound at a lower mid- and low frequency range at the housing 102. This produces a rich spatial frequency diversity sound smoothly along a general vertical axis of the audio speaker assembly 100. The following exemplary graphs further explains the spatial frequency diversity of the audio speaker assembly 100.

Figure 1B:
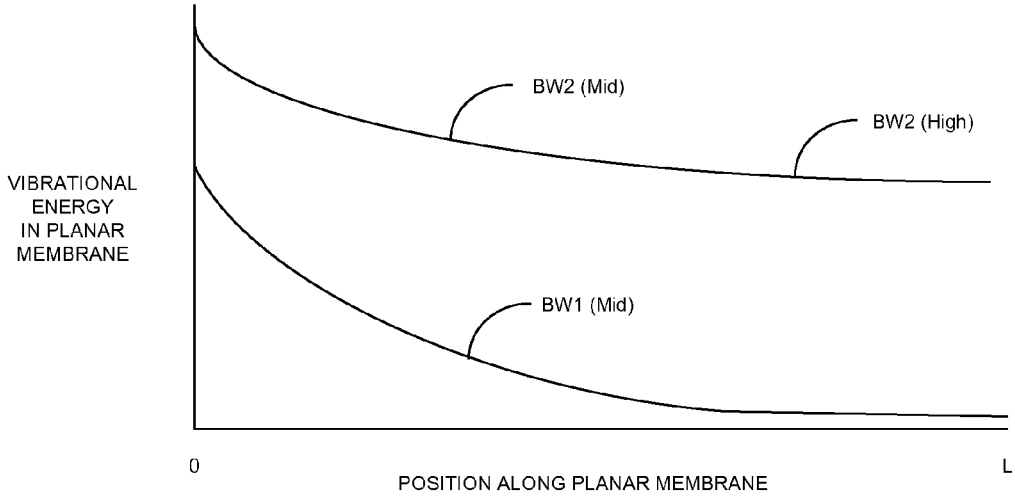
FIG. 1B illustrates a graph of an exemplary spatial frequency response of an elongated planar membrane in accordance with another aspect of the disclosure.

FIG. 1B illustrates a graph of an exemplary spatial frequency response of the planar membrane 104 in accordance with another aspect of the disclosure. The vertical axis of the graph represents the vibrational energy in the planar membrane 104. The horizontal axis of the graph represents the vertical position along the planar membrane 104 from a point proximate the slot 106 to the top of the planar membrane 104.

The graph depicts a first spatial frequency response BW1 (mid). The first spatial frequency response BW1 (mid) represents the contribution of sound energy generated in the planar membrane 104 by the first transducer 112. As previously discussed, the first transducer 112 produces vibrational energy in the low and lower-mid frequency ranges. Due to the inherent frequency response of the planar membrane 104, a portion of the lower mid-frequency range of the audio energy produced by the first transducer 112 ends up being produced as sound by the planar membrane 104. As noted, most of this energy is produced at the lower region of the planar membrane 104 due to: (1) the frequency response of the planar membrane 104 favoring the production of sound in the lower mid-frequency range at the lower region of the membrane; and (2) the fact that the first transducer 112 is indirectly coupled to the planar membrane (e.g., via the housing 102), the energy of the lower mid-frequency range of the audio sound only propagates a certain distance along the planar membrane 104.

The graph depicts a second spatial frequency response BW2 (Mid) and BW2 (High). The second frequency spatial response BW2 (Mid) and BW2 (High) represents the contribution of sound energy generated in the planar membrane 104 by the second transducer 114. As previously discussed, the second transducer 114 produces vibrational energy in the upper mid- and high-frequency ranges. Due to the inherent frequency response of the planar membrane 104, a portion of the upper mid-frequency range of the audio energy produced by the second transducer 114 ends up being produced as sound at lower and mid regions of the planar membrane 104. And, the high frequency range of the audio energy produced by the second transducer ends up being produced as sound at an upper region of the planar membrane 104. This results in spatial frequency diversity of sound along the length of the planar membrane 104.

Figure 1C:
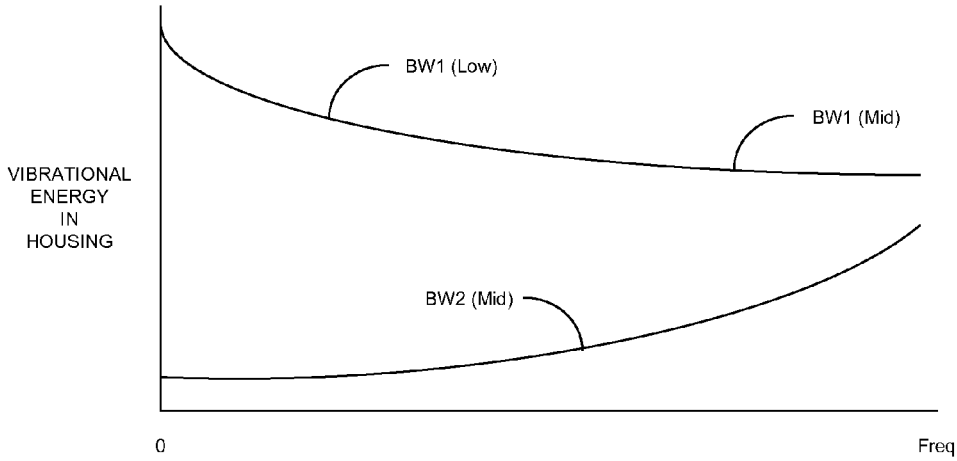
FIG. 1C illustrates a graph of an exemplary frequency response of a support housing in accordance with another aspect of the disclosure.

FIG. 1C illustrates a graph of an exemplary frequency response of the housing 102 in accordance with another aspect of the disclosure. The vertical axis of the graph represents the vibrational energy in the housing 102. The horizontal axis of the graph represents the frequency of the sound energy produced by the housing 102.

The graph depicts a first frequency spatial response BW1 (Low) and BW1 (Mid). The first frequency spatial response BW1 (Low) and BW1 (Mid) represents the contribution of sound energy generated in the housing 102 by the first transducer 112. As previously discussed, the first transducer 112 produces vibrational energy in the low and lower mid-frequency ranges. The energy of sound generated by the housing 102 due to the first transducer 112 is relatively high due to the direct coupling or attachment of the first transducer to the housing.

The graph depicts a second frequency response BW2 (Mid). The second frequency response BW2 (mid) represents the contribution of sound energy generated in the housing 102 by the second transducer 114. As previously discussed, the second transducer 114 produces vibrational energy in the upper mid- and high-frequency ranges. Due to the inherent frequency response of the housing 102, a portion of the upper mid-frequency range of the audio energy produced by the second transducer 114 ends up being produced at sound by the housing 102. Because the second transducer 114 is indirectly coupled to the housing 102 (by way of the planar membrane 104), the sound energy generated in the housing 102 due to the second transducer 114 is less than the sound energy due to the first transducer 112. This results in frequency diversity of sound generated by the housing 102.

Figure 1D:
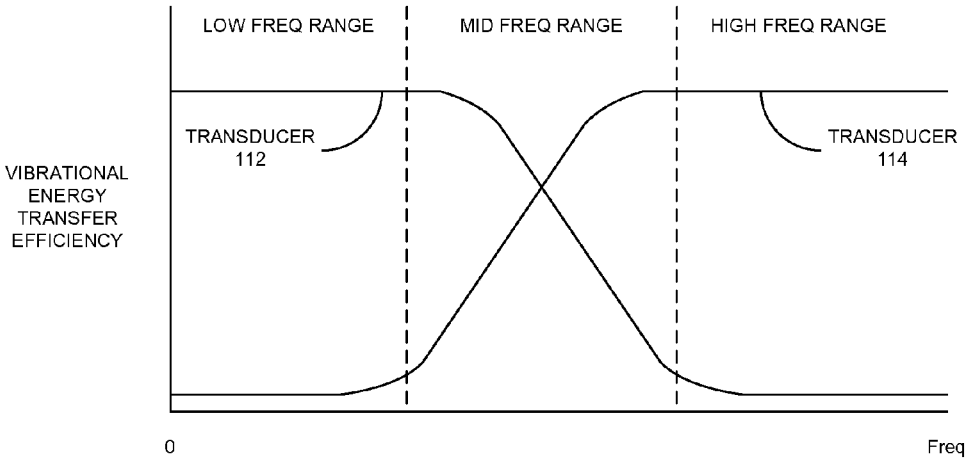
FIG. 1D illustrates a graph of exemplary vibrational energy transfer efficiency responses of a pair of associated transducers in accordance with another aspect of the disclosure.

FIG. 1D illustrates a graph of exemplary vibrational energy transfer efficiency responses of the first and second transducers 112 and 114 in accordance with another aspect of the disclosure. The vertical axis of the graph represents the vibrational energy transfer efficiency associated with the transducers 112 and 114. The horizontal axis of the graph represents the frequency of the vibrational energy produced by the transducers 112 and 114.

As noted, the first transducer 112 is configured to have a frequency response that has a high vibrational energy transfer efficiency at the low and lower mid-frequency ranges. This results in an efficient transfer of energy to the housing 102 for the production of sound in those frequency ranges. The second transducer 114 is configured to have a frequency response that has a high vibrational energy transfer efficiency at the upper mid- and high-frequency ranges. This results in an efficient transfer of energy to the planar membrane 104 in those frequency ranges. Again, this is done to produce spatial frequency diversity of sound along the audio speaker assembly 100.

Figure 1E:
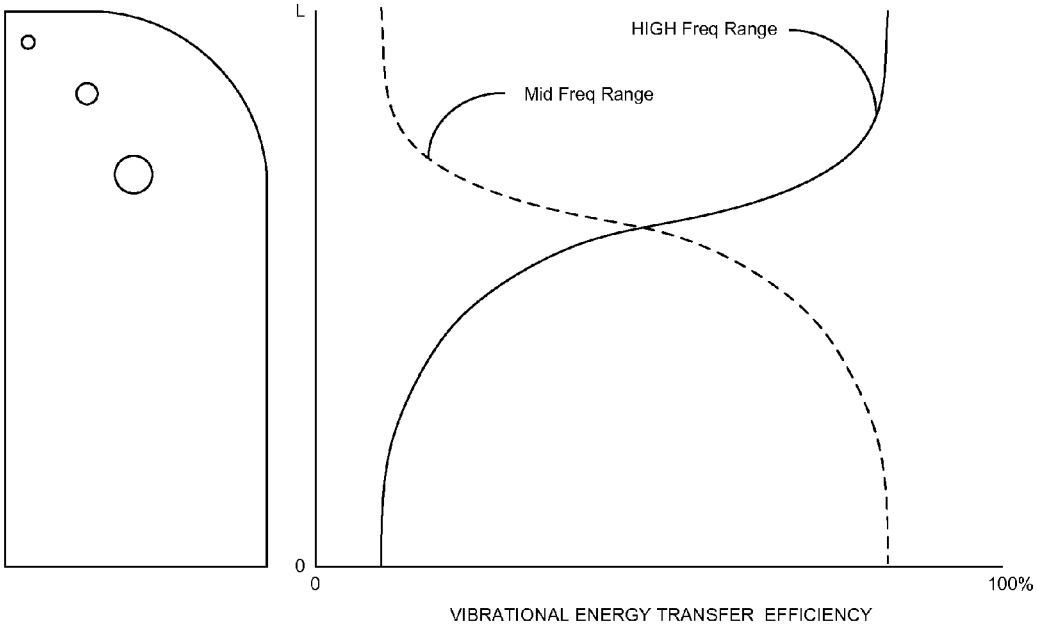
FIG. 1E illustrates a view of an exemplary planar membrane and a juxtaposed graph of an exemplary vibrational energy transfer efficiency to the planar membrane by a pair of transducers in accordance with another aspect of the disclosure.

FIG. 1E illustrates a view of the planar membrane 104 and a juxtaposed graph of an exemplary vibrational energy transfer efficiency to the planar membrane by the transducers 112 and 114 in accordance with another aspect of the disclosure. The vertical axis of the graph represents the position along the length of the planar membrane 104. The horizontal axis of the graph represents the vibrational energy transfer efficiency. The solid line indicates the transfer efficiency associated with the high-frequency range of the audio energy. The dash line indicates the transfer efficiency associated with the mid-frequency range of the audio energy.

As noted, the vibrational energy transfer efficiency associated with the high-frequency range is relatively high at the upper end of the planar membrane 104, and relatively low at the lower end of the membrane. This is due to the fact that there is less mass at the upper region of the planar membrane 104. The less mass at the upper region is due to the narrowing width caused by the curved edge and the one or more thru-holes in that region. In contrast, the vibrational energy transfer efficiency associated with the mid-frequency range is relatively high at the low and mid regions of the planar membrane 104, and relatively low at the upper end of the membrane. This is due to the fact that there is relatively more mass at the lower and mid regions of the planar membrane 104. Again, this produces spatial frequency diversity of sound along the audio speaker assembly 100.

Figure 1F:
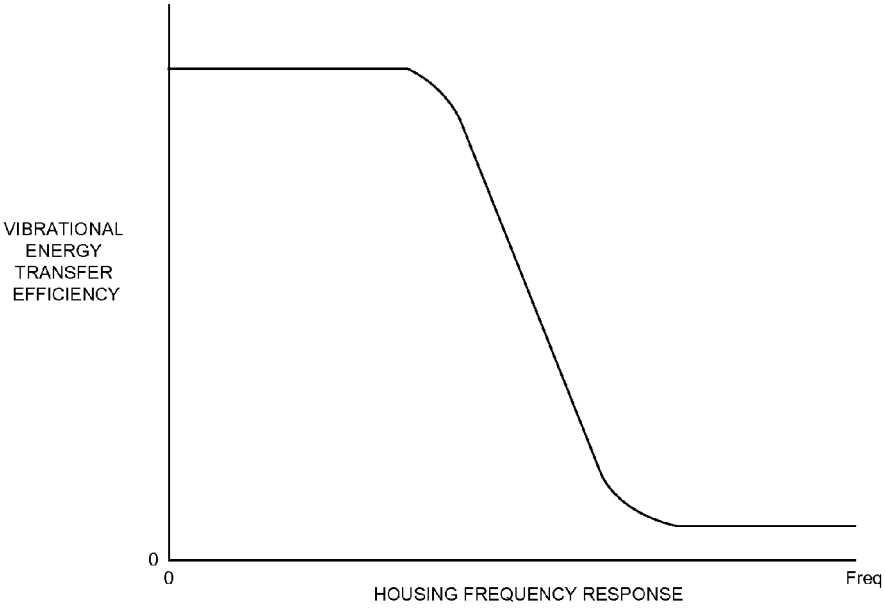
FIG. 1F illustrates a graph of a frequency response of an exemplary housing in accordance with another aspect of the disclosure.

FIG. 1F illustrates a graph of an exemplary frequency response of the housing 102 in accordance with another aspect of the disclosure. The vertical axis of the graph represents the vibrational energy transfer efficiency associated with the transfer of vibrational energy from the transducers 112 and 114 to the housing 102. The horizontal axis of the graph represents the frequency of the transferred vibrational energy. As noted, the transfer of vibrational energy from the transducers to the housing 102 is relatively high at the low and lower-mid frequency range of the vibrational energy, and relatively low at the upper frequency range. This results in lower frequency sound being efficiently produced by the housing 102. Again, this achieves spatial frequency diversity of sound produced by the audio speaker assembly 100. The following describes how these concepts may be embodied in speaker products.

Audio speakers typically include a relatively stiff diaphragm that is coupled to an electromagnetic driver. The driver generally includes a voice coil and a permanent magnet. The audio speakers are typically mounted so as to occupy an opening in an enclosure or housing. The varying magnetic field of the voice coil that is produced when a changing current is passed through the voice coil and the interaction of the magnetic field of the permanent magnet causes the loudspeaker diaphragm to vibrate. Vibration of the diaphragm causes movement of air, which in turn produces sound.

Figure 2A:
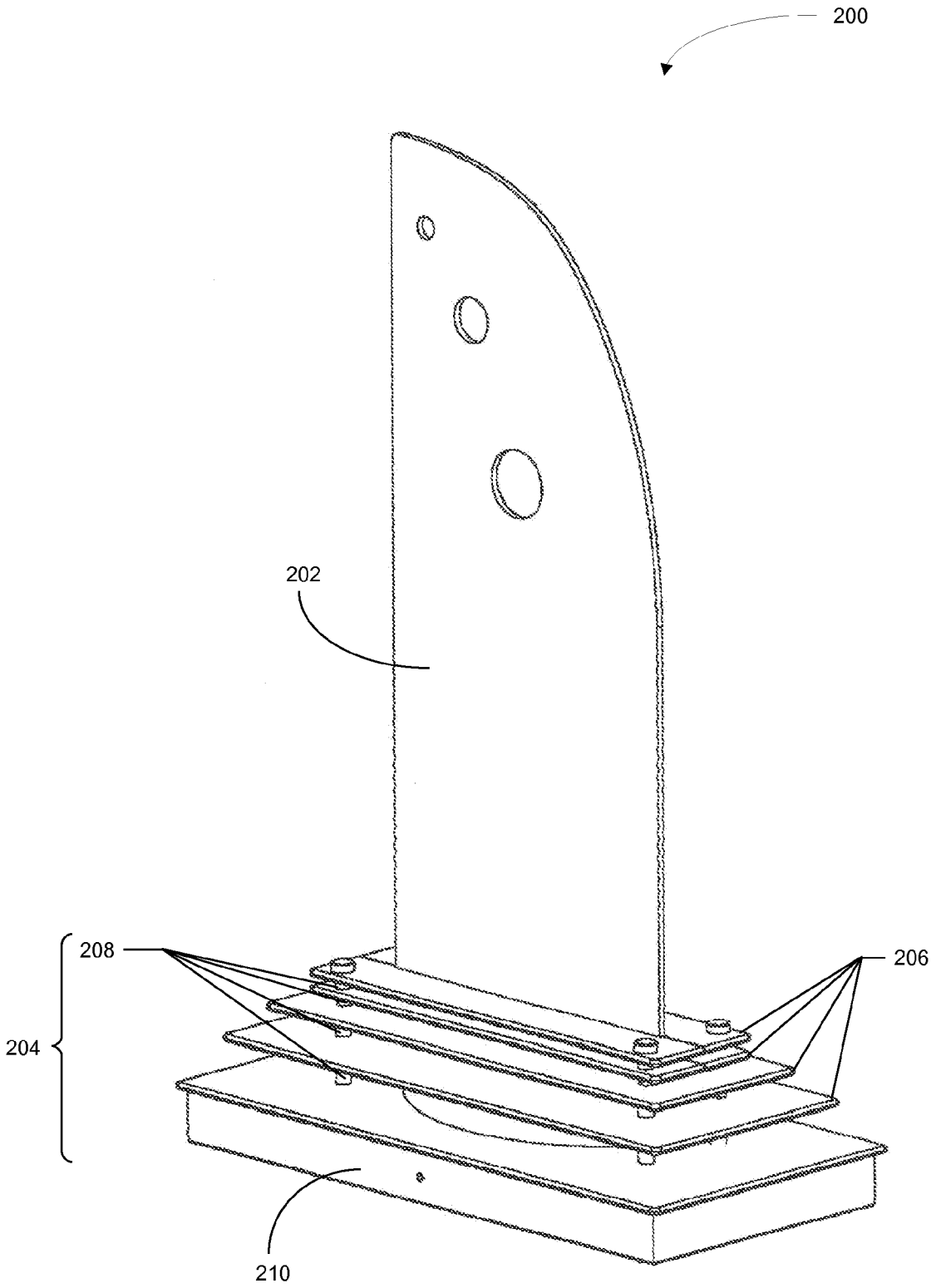
FIG. 2A illustrates a perspective view of another exemplary audio speaker assembly in accordance with another aspect of the disclosure.

FIG. 2A illustrates a perspective view of an exemplary audio speaker assembly 200 in accordance with another aspect of the disclosure. The audio speaker assembly 200 includes a membrane 202 that extends from a base housing 204. The base housing 104 is particularly designed to facilitate a vertical orientation of the speaker membrane 202 relative to the floor. The base housing 204 may take any particular shape that may define an internal compartment (See e.g., FIG. 2B) that is suitable for housing components of the speaker assembly 200. Externally, the base housing 204 may be designed in a plurality of varying decorative embodiments. In one embodiment, shown in FIG. 2A, the base housing 204 includes a plurality of stacked members 206. Each stacked member 206 may be made of tempered glass. At least some of the stacked members 206 are arranged to rest on top of the internal compartment. The stacked members 206 are separated by a plurality of spacers 208 arranged strategically between each stacked surface. The stack members 206 are mechanically coupled to the membrane 202, and thus, also emit sound due to the transfer of vibrational energy from the membrane to the stack members. The internal compartment, described in detail below, is positioned on a base 210 made of, a solid material, such as wood, a hard plastic, a metal and the like.

Figure 2B:
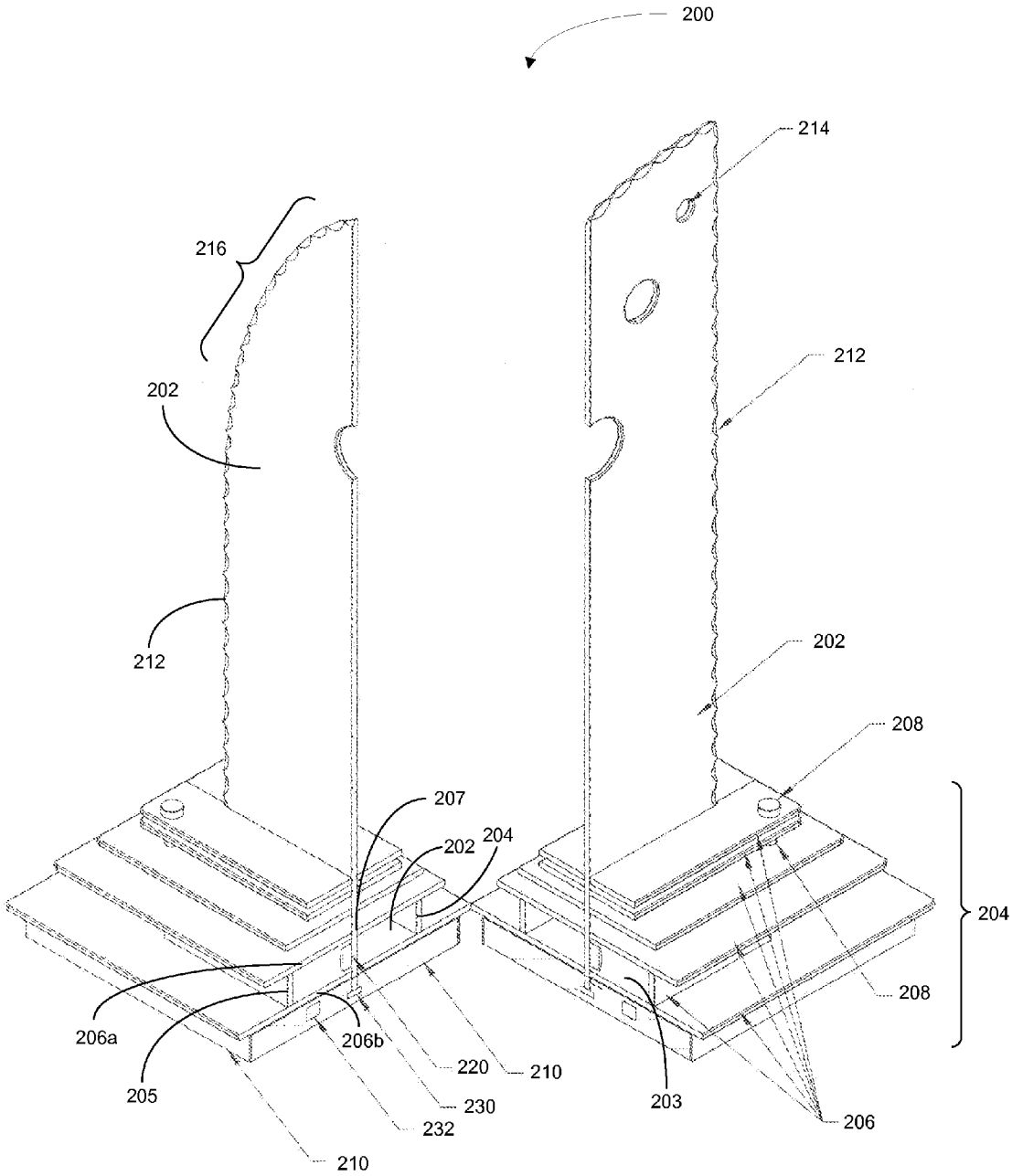
FIG. 2B illustrates a sectional view of the exemplary audio speaker in accordance with another aspect of the disclosure.

FIG. 2B illustrates a sectional view of the audio speaker assembly 200 in accordance with an embodiment showing the internal compartment 203 of the base housing 204. The internal compartment 203 is defined by a top wall 206*a,* lateral side walls 205, a front side wall (not shown) and a rear side wall (not shown), each resting on the base 210. In one embodiment, the top wall 206*a* is provided by one of the plurality of stacked members 206, and the lateral side walls 205 may be made of tempered glass. In one embodiment, one of the plurality of stacked members 206 may be positioned between the internal compartment 203 and the base 210 to provide a bottom wall 206*b* to the internal compartment 203.

While preferred materials are disclosed in the formation of the base housing 204 in accordance with embodiments described herein, other materials for the base housing 204 may be used without departing from the spirit of the present disclosure. Regardless of the material used in the construction of the base housing 204, the chosen material should resonate in a manner transmitting sound from the internal compartment 203.

The internal compartment 203 is provided with a slot 206*a* defined through the top wall 106*a*. On the opposite side from the top wall 106*a* is a slot 207 provided through the bottom wall 206*b* and into the base 210. The slot 207 is sized and shaped to receive a portion of the speaker membrane 202 therethrough. In accordance with an embodiment, the speaker membrane 202 is positioned substantially orthogonally relative to the base 210.

The membrane 202 may be attached to the base housing 204, through the internal compartment 203, to stand vertically erect or orthogonal relative to the base 210 using various well known fabrication techniques. One manner of coupling the membrane 202 to the base housing 204 is by sliding the membrane into the slots 207 such that a bottom edge of the membrane 202 comes to rest within the slot 207 in the base 210. The membrane 202 may be secured in the slots 207 and in the base 210 using, for example, an epoxy or other adhesive. Additionally or alternatively to the adhesive, the membrane 202 can be attached by press or friction fitting the membrane 202 into one or more of the slots 207.

In one embodiment, the membrane 202, having edges 212, is made of a rigid material, such as tempered glass. The membrane 202 is made thick enough and durable enough to endure the vibrational forces of a driver (described below), and yet flexible enough to vibrate in response to the driver. The membrane 202 produces the desired acoustic characteristics of the speaker assembly 200.

The sound quality of the speaker assembly may be improved by reducing the mass of the membrane 202. The mass of the membrane may be reduced using many techniques, such as providing small apertures 214 strategically located and positioned on the membrane 202. The apertures may vary in size from approximately 10 cm in diameter to 100 cm, with a final determination of size depending on the number of apertures 214 provided and the overall dimensions of the membrane 202.

In one embodiment, the membrane 202 may have a substantially rectangular geometry. However, mass may be removed from the membrane 202 by modifying the geometry of the membrane 202. In one embodiment, the membrane 202 may be modified such that one edge or a plurality of edges 212 of the membrane is shaped. For example, as shown in FIG. 2B, the edge 212 may be curved and formed into an arc shape 216. In other embodiments, the membrane 202 may be modified to other geometric shapes each providing the benefit of removing mass from an otherwise rectangular shaped membrane 202.

The speaker assembly 200 having a flat, vertically extending glass membrane provides a larger radiating area for higher sound pressure level with little displacement as compared to conventional cone type speakers. The membrane 202 is capable of reproducing an extremely wide range of frequencies at all listening angles from a single speaker element. In this way, acoustic blending problems associated with multi-element designs may be eliminated or reduced.

In another example, mass may be removed from the membrane 202 by varying the thicknesses along the height and width of the membrane 202.

Referring again to FIG. 2B, the speaker assembly 200 includes a driver 220 positioned in the internal compartment 203 and mounted to the membrane 202. The driver 220 vibrates in response to an electrical signal, which, in turn, vibrates the membrane 202 to produce sound.

The driver 220 may be an electromagnetic driver assembly that is well known in the art. In one embodiment, for example, the driver 220 may include a voice coil wrapped about a pole piece, a permanent magnet partially disposed within one end of the pole piece, and a thin plate attached to the other end of the pole piece. In order to vibrate the driver, a changing current is passed through the voice coil. The interaction of the magnetic field of the permanent magnet and the magnetic field of the voice coil that is produced from the changing current causes the coil and consequently, the attached thin plate 308 (FIG. 3) to vibrate like a piston with respect to the permanent magnet.

Figure 3:
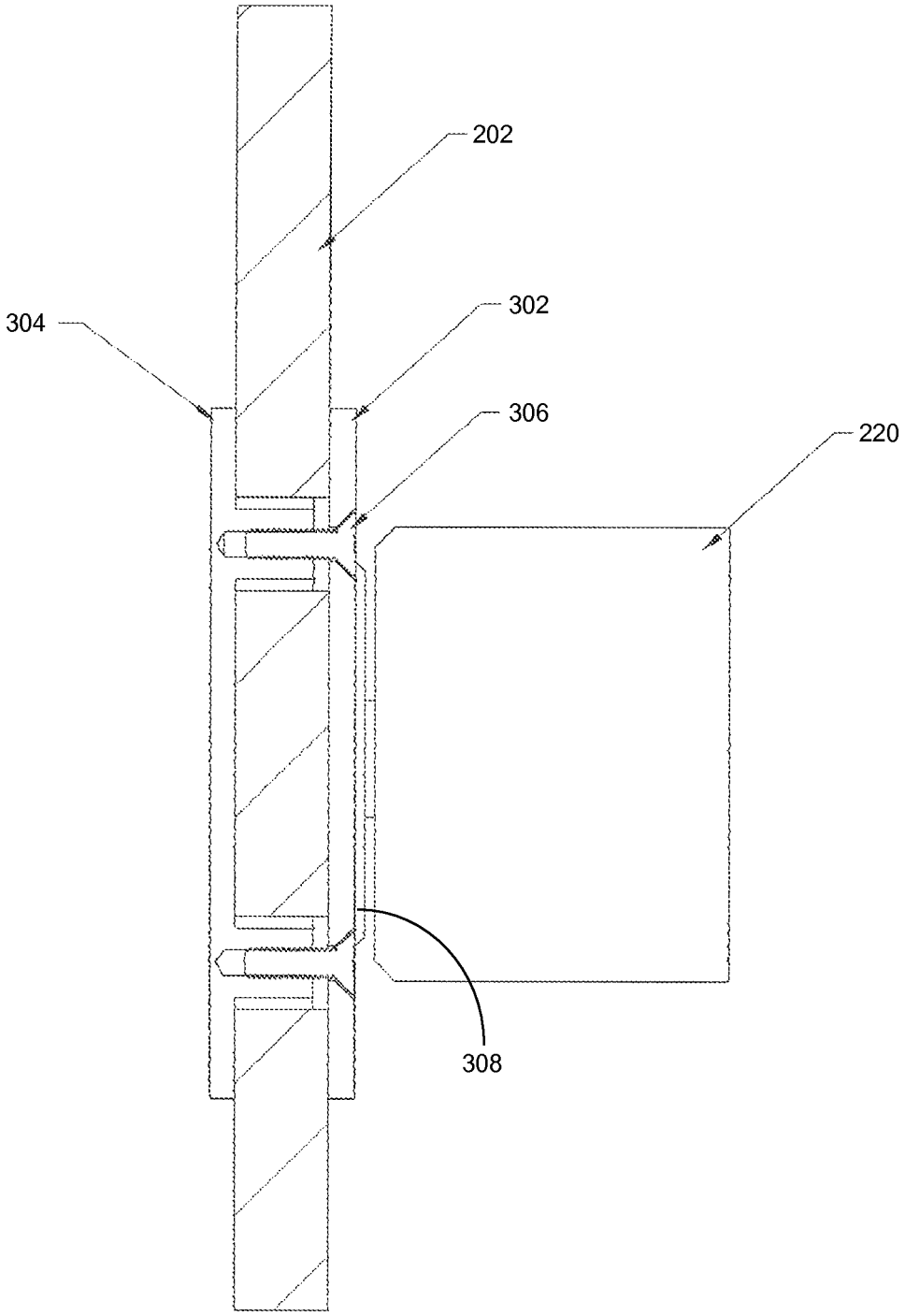
FIG. 3 illustrates a side view of an exemplary driver mounted to a planar membrane in accordance with another aspect of the disclosure.

As shown in FIG. 3 the driver 220 is mounted to the membrane 202 using a driver mounting plate 302. In this embodiment, the driver mounting plate 302 is mounted to the membrane 202 using a mounting bracket 304 that captures the driver mounting plate 302 via holes defined through the membrane 202. The driver mounting plate 302 and the mounting bracket 304 may be held together using conventional means 306, such as using screws or similar fasteners. As the thin plate 308 vibrates, the membrane 202 consequently vibrates to produce sound.

Referring back to FIG. 2B, in one embodiment, the audio speaker assembly 200 may include lighting effects. The lighting effects allow the user to change the appearance of the membrane 202 by using colored light that permeates through the membrane to provide different hues. In one embodiment, the lighting effects may be provided using LED strip lighting 230 that is strategically placed along various portions of the audio speaker assembly 200. The LED light strips 230 may be coupled together or controlled independently using an LED controller and power supply 232. The lighting effects may include a variety of colors and hues and may be powered to different intensities to create a range from dim to bright lighting. The color of the lighting may be set to a specific color or it may be allowed to vary and change at different timing intervals.

Figure 4:
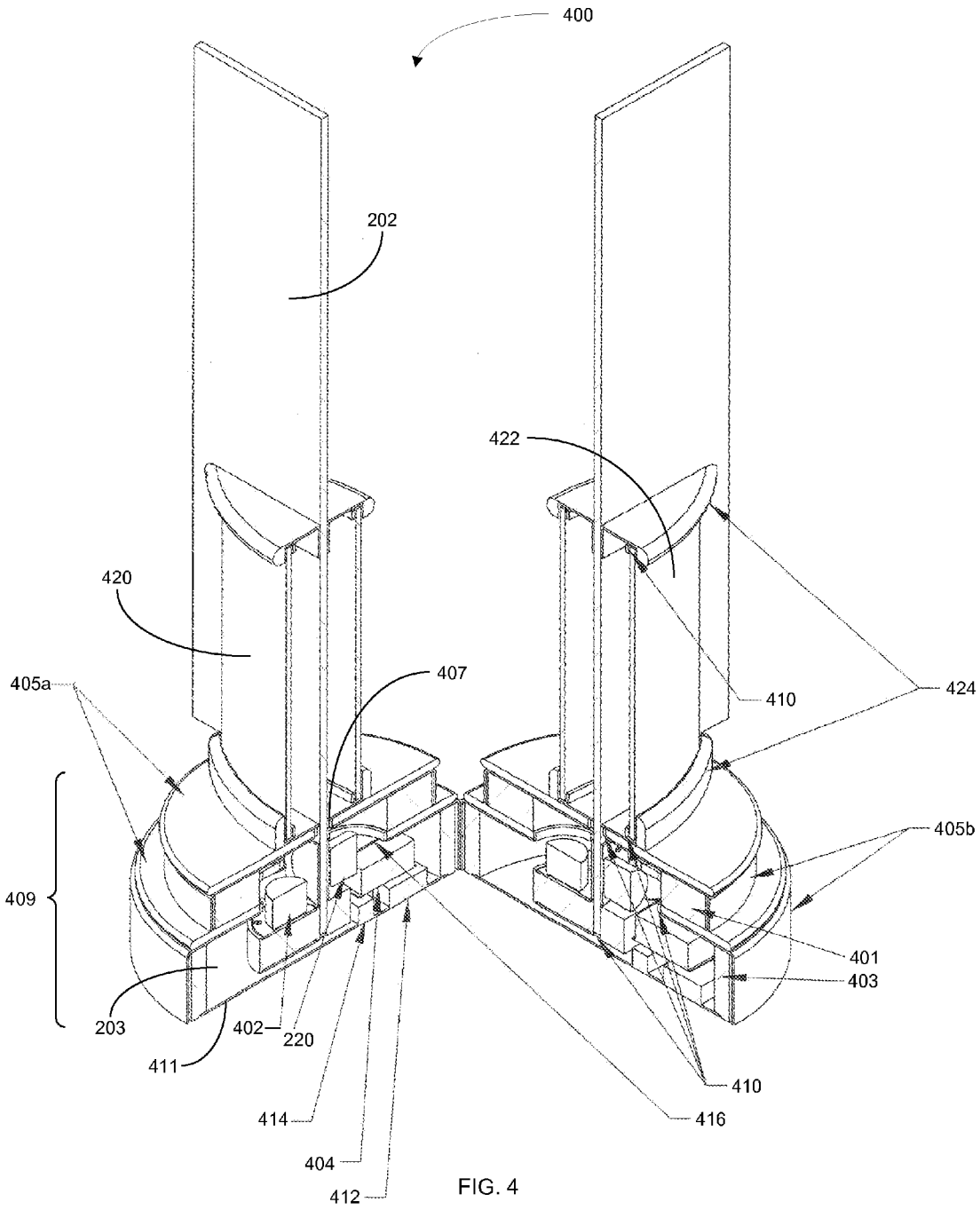
FIG. 4 illustrates a perspective sectional view of another exemplary audio speaker assembly in accordance with another aspect of the disclosure.

FIG. 4 illustrates a sectional view of an audio speaker assembly 400 in accordance with an embodiment. The audio speaker assembly 400 includes the features described above with regard to audio speaker assembly 200, however, the description of this embodiment may provide for some additional features not described above that may be found in each of the speaker assembly embodiments described herein.

In this embodiment, the audio speaker assembly 400 includes a first circular tier 401 and a second tier 403. The first and second circular tiers 401 and 403 are made of a solid material, such as wood, a hard plastic, a metal and the like. In one embodiment, each tier 401 and 403 is covered with a decorative feature, such as a cover member **405*a* made of, for example, tempered glass, and side coverings 405*b* made of, for example, decorative plastic or aluminum. The first and second tiers are stacked concentrically and rest on a base 411**.

The stacked circular tiers 401 and 403 include a hollowed out or open portion that defines the internal compartment 203. The first circular tier 401 includes a slot 407 defined through the decorative feature resting on top of the first circular tier 401. The slot 407 is sized and shaped to receive a portion of the speaker membrane 202 therethrough. The speaker membrane 202 extends and is secured within the internal compartment 203 using various well known fabrication techniques. The membrane 202 rests substantially orthogonally oriented relative to the base 411 of the base housing 409.

The driver 220 is mounted within the internal compartment 203 to the glass membrane 202 using, for example, the mounting plate 302 and the mounting bracket 304 (See e.g., FIG. 3). In this embodiment, an additional sound device 402 is provided. By securing the driver 220 to an additional sound device, such as a wood membrane and the like, lower sound frequencies can be produced. An amplifier 404 including a power supply are also located in the internal compartment 203 and are used in conjunction with the driver 220. The amplifier 404 is to provide the driver 220 with the signal voltages appropriate for the functional of the driver.

In one embodiment, the audio speaker assembly 400 includes a wireless receiver 416. The wireless receiver 416 may be located in the internal compartment 203 and is capable of receiving control signals from which to control the driver 220, the amplifier 404 and power converter 406 to provide the ability to remotely control the audio speaker assembly 400.

In one embodiment, the audio speaker assembly 400 may include lighting effects. The lighting effects allow the user to change the appearance of the membrane 202 by using colored light that permeates through the membrane to provide different hues. In one embodiment, the lighting effects may be provided using LED strip lighting 410 that is strategically placed along various portions of the audio speaker assembly 400. The LED light strips 410 may be coupled together or controlled independently using an LED controller 412 powered by an LED power inverter 414. The light effects may include a variety of colors and hues and may be powered to different intensities to create a range from dim to bright lighting. The color of the lighting may be set to a specific color or it may be allowed to vary and change at different timing intervals.

In one embodiment, the audio speaker assembly 400 includes a wireless receiver 416. The wireless receiver 416 may be located in the internal compartment 203 and is capable of receiving control signals from which to control the LED controller 412 to provide the ability to remotely control the lighting effects.

In this embodiment, an optional upper housing 420 may be provided that is mounted upon the first circular tier 401 and extends along a portion of the height of the membrane 202. The upper housing 420 includes panels 422. The panels 422 are curved or arced members that are positioned on each side of the membrane 202 to create an enclosed space that surrounds a portion of the membrane 202. The curved panels 422 are held in position using mounting brackets 424. In one embodiment, lighting strips 410 may be positioned with in the upper housing 420 to provide additional lighting effects to the speaker assembly 400.

Figure 5A:
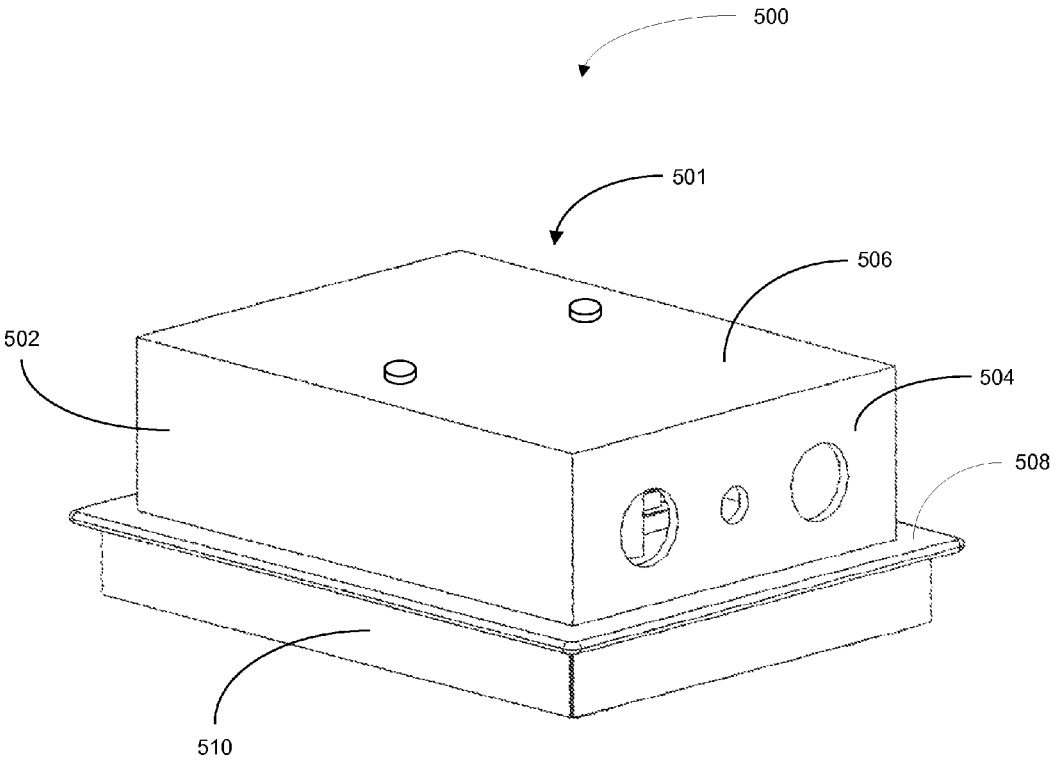
FIG. 5A illustrates a perspective view of an exemplary subwoofer assembly in accordance with another aspect of the disclosure.

In one example, with no intent to be limiting, the speaker assemblies may have the following characteristics:
Speaker output: about 50 Watts,
Impedance: about 8 Ohms,
Frequency response: 50 Hz-20 kHz
Dimensions: (L×W×H) 21.5"×43"×65.5"
Decibel: about 90 dB FIG. 5A illustrates a perspective view of an exemplary subwoofer assembly 500 in accordance with another aspect of the disclosure. Subwoofer assembly 500 includes a substantially rectangular housing 501 including opposed lateral side walls 502, opposed end walls 504, a top wall 506 and a bottom wall 508 (See e.g., FIG. 5B). The walls rest on a back plate or base 510. The housing 501 may be made from any materials that resonate in a manner transmitting sound from the interior of the housing. In one embodiment, the housing 501 may be made from ½ to ¼ inch thick tempered glass.

Figure 5B:
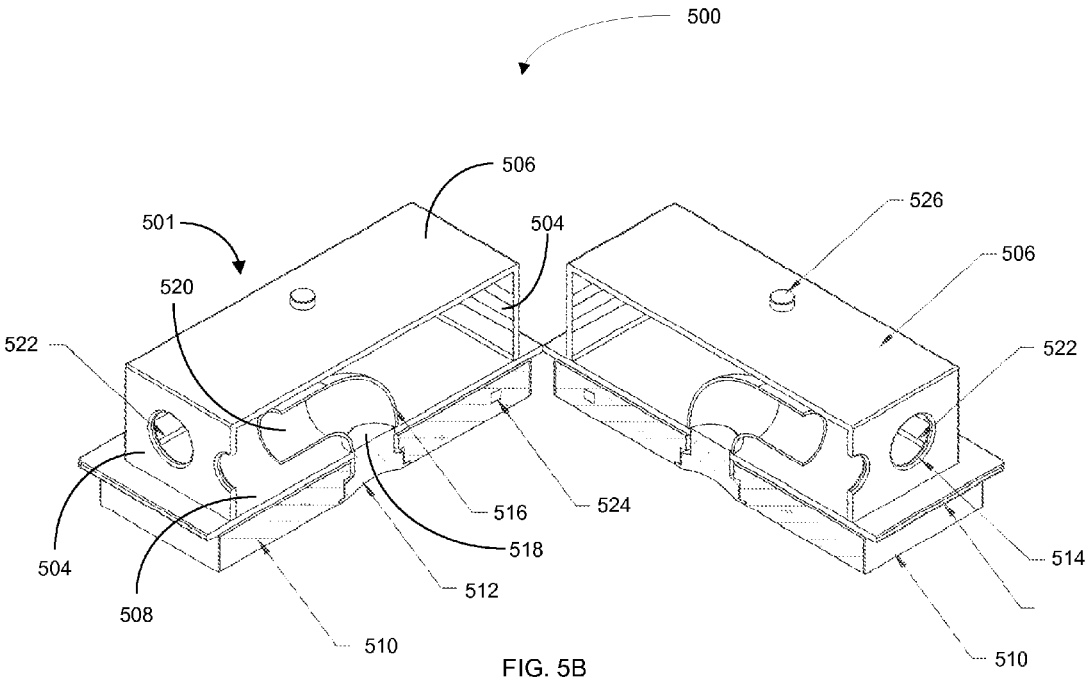
FIG. 5B illustrates a sectional view of the exemplary subwoofer assembly in accordance with aspect of the disclosure.

As shown in FIG. 5B, a centrally mounted sound device 512 is secured to the base 510 of the housing 501. The sound device 512, is for example a woofer driver. The base 510 has a recess provided for the sound device 512. In one embodiment, the recess in the base 510 is centrally located with respect to the housing 501. The sound device 512 is placed inside the recess such that one end of the sound device is aligned with and preferably attached to the bottom of the base 510. The bottom of the housing 501 remains open to be ultimately closed off when the subwoofer assembly 500 is placed on the floor.

In one embodiment, a plurality of openings 514 are defined on end walls 504. The openings 514 are provided to release the air that is trapped between the walls 502, 504, 506 and 508 of the housing 501. The number and size of the openings 514 are design choices that affect the sound quality.

In one embodiment, a port tube 516 is positioned over the bottom of the sound device 512. The port tube 516 may be made of any suitable material, preferably glass. The port tube 516 has a first opening 518 that is positioned over the sound device 512 and a second opening 520 that is directed toward the openings 514 on the side wall 504. In this manner, air is directed from the sound device directly to the openings 512. The port tube 516 allows air to be removed more efficiently from with the housing 501 to improve sound emissions by making a clear path for the movement of air.

In one embodiment, the subwoofer assembly 500 may include lighting effects. The lighting effects allow the user to change the appearance of the housing 501 using colored light that permeates through the walls to provide different lighting hues. In one embodiment, the lighting effects may be provided using LED strip lighting 522 that is strategically placed along various portions of the housing 501. The LED light strips 522 may be coupled together or controlled independently using an LED controller and LED power inverter 524.

Figure 6:
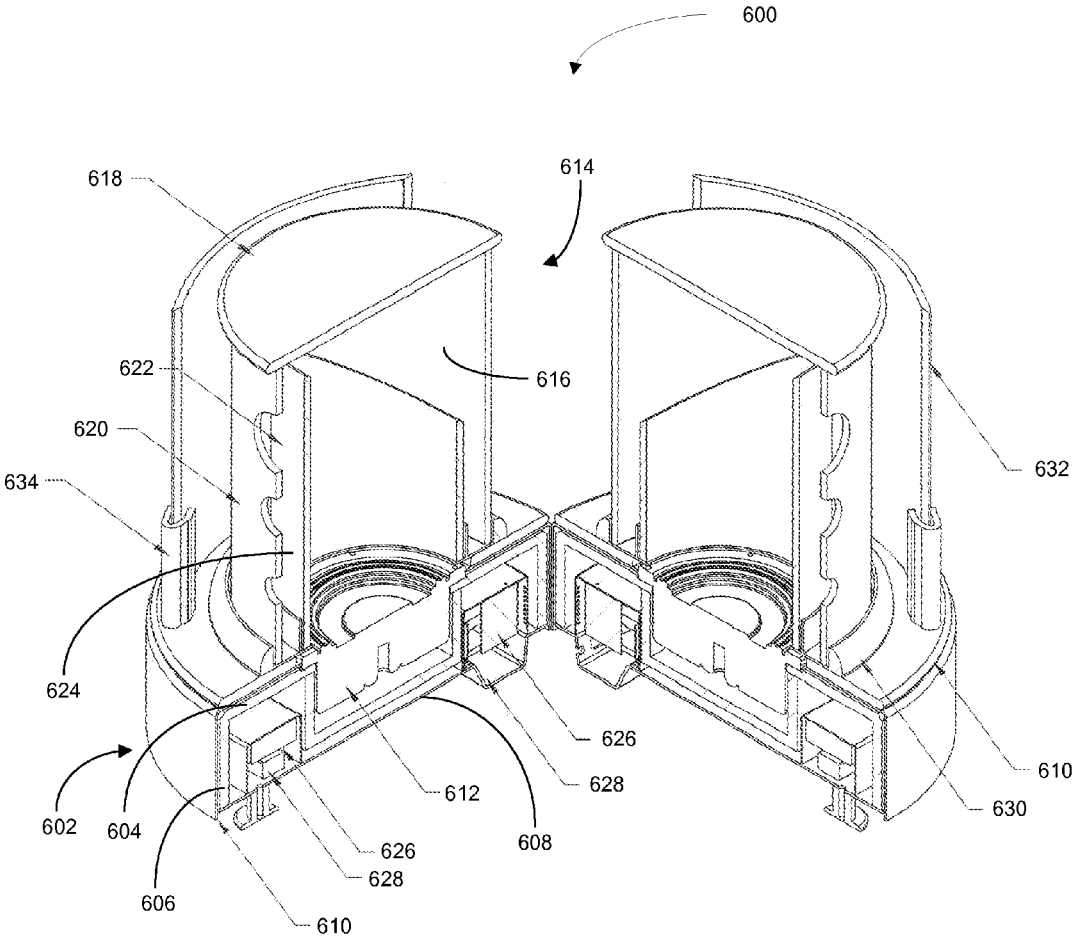
FIG. 6 illustrates a perspective sectional view of another exemplary subwoofer assembly in accordance with another aspect of the disclosure.

FIG. 6 illustrates a perspective sectional view of a subwoofer assembly 600 in accordance with another aspect of the disclosure. Subwoofer assembly 600 includes a substantially circular base housing 602. In one embodiment, the circular base housing 602 includes a top wall 604, a side wall 606 and a bottom wall or base plate 608. The walls and bottom plate are configured to create internal recesses and compartments used to position various components of the subwoofer assembly. The top and side wall of the base housing 602 may be made from any suitable material, such as wood, hard plastic and metal. The top wall 604 and side wall 606 may be covered by suitably decorative surface features 610, such as glass, plastic, aluminum and the like.

A portion of the base housing is recessed from the top wall. A centrally mounted sound device 612, such as a conventional bass speaker, is secured to the top wall of the base housing 602. The sound device 612 is positioned to extend inside the recess such that one end of the sound device 612 is aligned with the top wall 604 of the base housing 602. The sound device 612 is, for example, a sub-woofer.

In one embodiment, an upper housing structure 614 is mounted on top of the top wall 604. The upper housing structure 614 is a generally cylindrical shaped structure that encloses a space 616 directly above the sound device 612. On the top end of the upper housing structure 614 is a top wall 618 that encloses the structure. A side wall 620 of the upper housing structure 614 may include a plurality of openings 622 provided to release the air that is trapped within the enclosed space 616. The number and size of the openings 622 are design choices that affect the sound quality.

Optionally, an internal wall structure 624 may be disposed within the enclosed space 616 for aesthetic reasons to, for example, cover or hide the sub-woofer.

In one embodiment, the subwoofer assembly 600 may include lighting effects. The lighting effects allow the user to change the appearance of the base housing 602 and the upper housing structure 614 using colored light that permeates through the walls to provide different lighting hues. In one embodiment, the lighting effects may be provided using LED strip lighting that is strategically placed along various portions of the base housing 602. The LED light strips may be coupled together or controlled independently using an LED controller 626 and LED power inverter 628.

In one embodiment, the subwoofer assembly 600 may include other features. For example, the upper housing structure 614 may be surrounded by a bracket 630 that secures the upper housing structure in position. In one embodiment, decorative features may be added to the subwoofer assembly 600. These features may include at least one to a plurality of freestanding panels 632 hold in position using decorative brackets 634. The panels 632 may be made of any suitably decorative material for example, plastic or glass.

Figure 7A:
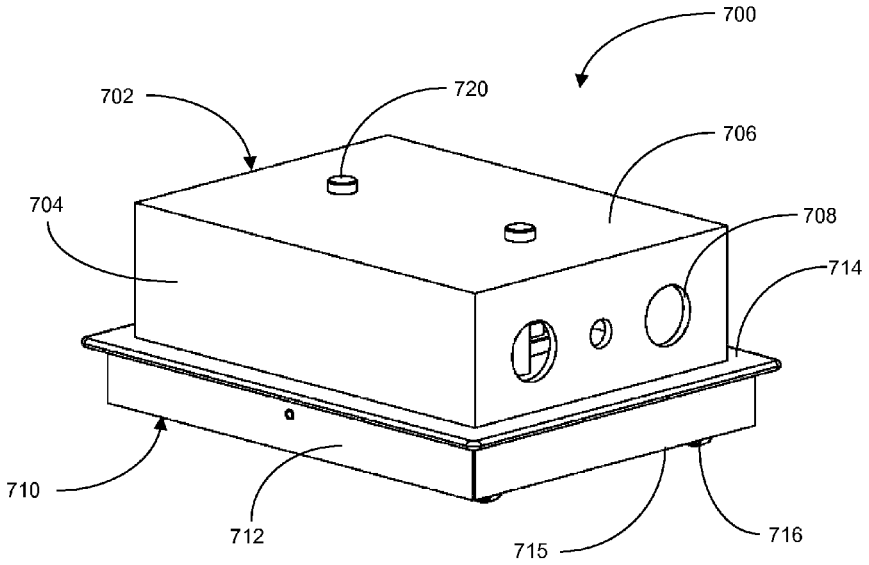
FIG. 7A illustrates a perspective view of an exemplary speaker assembly in accordance with another aspect of the disclosure.

In one example, with no intent to be limiting, the subwoofer assembly may have the following characteristics:
Speaker output: 150 Watts
Impedance: about 6 Ohms
Frequency response: 20 Hz-300 Hz
Dimensions: (L×W×H) 28"×22"×11.5"
Decibel: about 91 dB FIG. 7A illustrates a perspective view of an exemplary speaker assembly 700 in accordance with another aspect of the disclosure. In this example, the speaker assembly 700 may be configured as a subwoofer for generating lower-end frequency audio. In particular, the speaker assembly 700 comprises an upper housing 702 disposed and securely mounted on a lower housing or base 710. The upper housing 702 may be configured in any shape. However, in this example, the upper housing 702 is configured generally rectangular in shape, including a plurality of sidewalls 704 and a top wall 706. Further, in accordance with this example, the upper housing 702 does not include a bottom wall.

The upper housing 702 may include one or more holes 708 to facilitate the flow of air between the interior and exterior of the upper housing 702 caused by the operation of an internal transducer, as further discussed herein. The one or more holes 708 may be formed through one or more of the sidewalls 704 as shown, and/or through the top wall 706. The characteristic of the sound generated by the speaker assembly 700 depends on the shape, size and position of the one or more holes 708, and may be configured to achieve a desired acoustic response for the speaker assembly.

The lower housing 710 may also be configured in any shape. However, in this example, the lower housing 710 is configured generally rectangular in shape, including a plurality of sidewalls 712, a top wall 714, and a bottom wall 715. A plurality of caster wheels 716 may be mounted to the bottom wall 715 to facilitate moving the speaker assembly 700. A securing mechanism 720, such as a bolt or screw, may be used to securely attach the upper housing 702 to the lower housing 710.

Figure 7B:
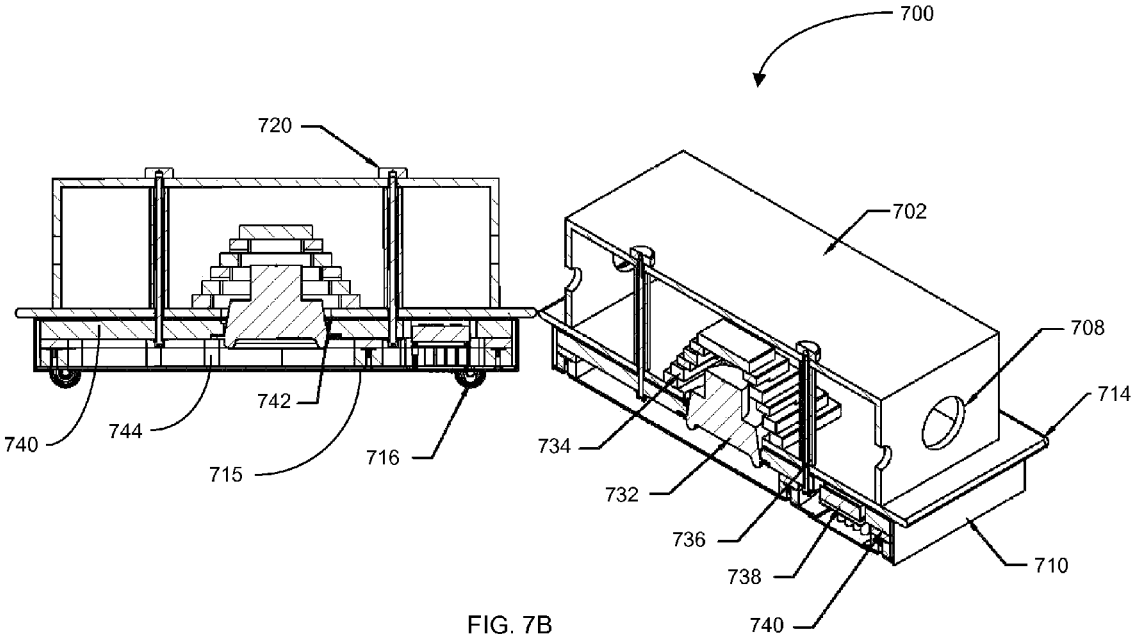
FIG. 7B illustrates a sectional view of the exemplary speaker assembly in accordance with aspect of the disclosure.

FIG. 7B illustrates a sectional view of the exemplary speaker assembly 700 in accordance with another aspect of the disclosure. This figure illustrates the internal workings of the speaker assembly 700. In particular, the speaker assembly 700 comprises a transducer 732 (e.g., a subwoofer) mounted to a wooden frame 740 situated within the lower housing 710 and supported therein in a generally horizontal orientation by a plurality of spacers 740 mounted to the bottom wall 714 of the lower housing. The wooden frame 740 and upper wall 714 of the lower housing 710 comprises registered holes through which a portion of the transducer 732 from the lower housing to the upper housing.

A decorative structure 734, for example, in the form of a pyramid, may be disposed on the upper wall 714 of the lower housing 710, and positioned centrally over the transducer 732. The decorative structure 734 may be of individual glass pieces configured to form the decorative pyramid structure and also cover the transducer 732 for aesthetic reasons. The decorative structure 734 may include openings throughout to allow air flow caused by the operation of the transducer 732. A light source 742, for example, in the form of a lighting strip, may extend circularly around the transducer 732 and below the decorative pyramid structure 734, and configured to illuminate the decorative structure with different hues for aesthetic purposes. An amplifier 738 may be incorporated into the lower housing 710, and adapted to amplify an input audio signal to generate an output audio signal for driving the transducer 732. Additionally, spacers 736 may be provided through which the securing mechanism 720 extends from the upper housing 702 to the lower housing 710, whereby the lower end of the securing mechanism is attached to a bottom surface of the wooden frame 740.

While the invention has been described in connection with various embodiments, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. An audio speaker assembly, comprising:

a housing configured to produce sound with a first frequency response;

an elongated planar membrane supported in a vertical orientation by the housing, wherein the elongated planar membrane includes an entire lower region configured to produce sound with a second frequency response and an entire upper region configured to produce sound with a third frequency response, wherein the first frequency response favors relatively low frequencies, wherein the third frequency response favors relatively high frequencies, and wherein the second frequency response favors frequencies between the relatively low and relatively high frequencies; and a first transducer configured to produce vibrational energy in the housing and in the elongated planar membrane.

2. The audio speaker assembly of claim 1, further comprising a second transducer directly coupled to the housing.

3. The audio speaker assembly of claim 2, wherein the first transducer is directly coupled to the elongated planar membrane.

4. The audio speaker assembly of claim 3, wherein the first transducer is configured to more efficiently generate vibrational energy in the elongated planar membrane than in the housing, and further wherein the second transducer is configured to more efficiently generate vibrational energy in the housing than in the elongated planar membrane.

5. The audio speaker assembly of claim 4, further comprising a first filtering element configured to receive an input audio signal and output therefrom a first audio signal component that better matches the second and third frequency responses of the elongated planar membrane than the first frequency response of the housing, wherein the first audio signal component is used for driving the first transducer.

6. The audio speaker assembly of claim 5, further comprising a second filtering element configured to receive the input audio signal and output therefrom a second audio signal component that better matches the first frequency response of the housing than the second and third frequency responses of the elongated planar membrane, wherein the second audio signal component is used for driving the second transducer.

7. The audio speaker assembly of claim 1, wherein the elongated planar membrane comprises light transparent or opaque material.

8. The audio speaker assembly of claim 7, further comprising a light source adapted to produce light with a defined hue through the elongated planar membrane.

9. The audio speaker assembly of claim 8, further comprising a wireless receiver adapted to receive a control signal for controlling the defined hue of the light.

10. The audio speaker assembly of claim 1, wherein the elongated planar membrane comprises a curved edge or one or more holes at the entire upper region of the elongated planar membrane.

11. The audio speaker assembly of claim 10, wherein the entire lower region of the elongated planar membrane is substantially rectangular in shape.

12. The audio speaker assembly of claim 1, wherein the housing forms an enclosure, and wherein at least a portion of the elongated planar membrane is situated within the enclosure of the housing.

13. The audio speaker assembly of claim 12, wherein the housing comprises an upper wall including a slot through which the elongated planar membrane extends in a substantially fitted configuration.

14. The audio speaker assembly of claim 13, further comprising an anchor securely attaching the elongated planar membrane to the housing, wherein the anchor is situated within the enclosure of the housing.

15. The audio speaker assembly of claim 12, further comprising a light source situated within the enclosure of the housing, wherein the light source is configured to emit light through the elongated planar membrane.

16. The audio speaker assembly of claim 15, further comprising a user interface configured to allow a user to control a hue of the light emitted by the light source.

17. The audio speaker assembly of claim 16, wherein the user interface comprises a wireless interface to allow the user to control the hue of the light using a remote control.

18. The audio speaker assembly of claim 12, wherein the first transducer is situated within the enclosure of the housing.

19. The audio speaker assembly of claim 18, further comprising a second transducer configured to produce vibrational energy in the housing and in the elongated planar membrane, wherein the second transducer is situated within the enclosure of the housing.

20. The audio speaker assembly of claim 19, further comprising:

an audio amplifier configured to generate an amplified audio signal from an input audio signal;

a first filter configured to generate a first filtered audio signal from the amplified audio signal, wherein the first transducer is configured to be driven by the first filtered audio signal; and a second filter configured to generate a second filtered audio signal from the amplified audio signal, wherein the second transducer is configured to be driven by the second filtered audio signal;

wherein the audio amplifier, the first filter, and the second filter are situated within the enclosure of the housing.

* * * * *